US008480269B2

(12) United States Patent
Horng et al.

(10) Patent No.: US 8,480,269 B2
(45) Date of Patent: Jul. 9, 2013

(54) LAMP AND HEAT SINK THEREOF

(75) Inventors: Alex Horng, Kaohsiung (TW); I-Le Fang, Kaohsiung (TW); Ming-Tsung Li, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 250 days.

(21) Appl. No.: 12/831,784

(22) Filed: Jul. 7, 2010

(65) Prior Publication Data

US 2012/0008330 A1 Jan. 12, 2012

(51) Int. Cl.
*F21V 29/00* (2006.01)

(52) U.S. Cl.
USPC ..... 362/373; 362/294

(58) Field of Classification Search
USPC ..... 362/294, 373
See application file for complete search history.

(56) References Cited

U.S. PATENT DOCUMENTS

| | | | | |
|---|---|---|---|---|
| 7,458,706 | B1 | 12/2008 | Liu et al. | |
| 7,637,635 | B2 | 12/2009 | Xiao et al. | |
| 7,648,258 | B2 | 1/2010 | Shuai et al. | |
| 2009/0109625 | A1 * | 4/2009 | Booth et al. | 361/702 |
| 2009/0135613 | A1 * | 5/2009 | Peng | 362/373 |

FOREIGN PATENT DOCUMENTS

| | | |
|---|---|---|
| CN | 201209840 | 3/2009 |
| CN | 101532648 | 9/2009 |
| TW | M330426 | 4/2008 |
| TW | M346745 | 12/2008 |

* cited by examiner

*Primary Examiner* — Anh Mai
*Assistant Examiner* — Michael Santonocito
(74) *Attorney, Agent, or Firm* — Muncy, Geissler, Olds & Lowe, PLLC

(57) ABSTRACT

A lamp comprises a housing, a heat sink, a fan and a light-emitting element. The housing includes an opening end and a compartment communicating with the opening end. The heat sink is disposed at the opening end and includes a lateral wall, a base, a plurality of first connection members, a plurality of first air channels and at least one second air channel. The base is surrounded by and spaced from the lateral wall. The base is connected to an inner circumferential wall of the lateral wall via the first connection members, wherein each of the first air channels is formed between adjacent two of the first connection members. The at least one second air channel is formed between an outer circumferential wall of the lateral wall and an inner face of the housing. The fan is disposed at one side of the heat sink in the compartment. The light-emitting element is disposed at another side of the heat sink.

14 Claims, 7 Drawing Sheets

LAMP AND HEAT SINK THEREOF

BACKGROUND OF THE INVENTION

1. Field of the Invention

The present invention generally relates to a lamp and a heat sink thereof and, more particularly, to an embedded lamp utilizing a fan to trigger air flow for ventilation, as well as a heat sink thereof.

2. Description of the Related Art

Taiwan Patent Number M330426 discloses a conventional lamp as shown in FIG. 1. In FIG. 1, the lamp as shown is 180 degree inversed relative to an assembly direction. The lamp has a cooling base 81, a circuit board 82, a light-emitting diode (LED) module 83, a cooling fan 84 and a lamp head 85. The cooling base 81 has a concave portion 811 and a receiving portion 812. The circuit board 82 and LED module 83 are received in the concave portion 811. The cooling fan 84 is received in the receiving portion 812. The lamp head 85 is coupled to an outer portion of the receiving portion 812. The cooling base 81 includes a plurality of heat-dissipating holes 813 extending into the receiving portion 812. The lamp head 85 includes a plurality of vents 851 into which external air is drawn. During operation of the lamp, the external air is drawn into the receiving portion 812 via the vents 851 and then exhausted out of the receiving portion 812 via the heat-dissipating holes 813 for dissipating the heat generated by the lamp head 85.

When in use, the lamp head 85 is coupled to a lamp seat; and the vents 851 and the heat-dissipating holes 813 are made in contact with the external air so that air inside the receiving portion 812 is allowed to exchange with the external air. However, the vents 851 where the external air is drawn into the receiving portion 812 are located in a relatively upper portion of the lamp where heat air tends to gather (this is because that in thermal convection theory heat air tends to float around higher areas than cool air). Hence, the exhausted heat air from the heat-dissipating holes 813 tends to gather around the relatively upper portion of the lamp and is therefore re-drawn into the receiving portion 812 via the vents 851, leading to degradation of cooling efficiency. Furthermore, when the lamp is inserted into a "plate-type" ceiling (meaning the ceiling that is assembled from a plurality of square plates) for artistic consideration, the heat-dissipating holes 813 and the vents 851 are settled right above the plate-type ceiling, and only the LED module 83 and its related portions remain beneath the plate-type ceiling for illumination purpose. However, since the area above the plate-type ceiling is an enclosed space with poor air circulation, poor heat dissipation is therefore resulted. As a result, service life of the lamp is shortened.

Taiwan Patent Number M346745 discloses another conventional lamp as shown in FIG. 2. Referring to FIG. 2, the lamp includes an upper casing 91, a lower casing 92, a heat-dissipating assembly 93 and a LED assembly 94. The upper casing 91 includes a receiving room 911 in which the heat-dissipating assembly 93 and LED assembly 94 may be disposed. The upper casing 91 and lower casing 92 together may form a housing of a lamp. The upper housing 91 includes a plurality of vents 912 and the lower housing 92 includes a plurality of through-holes 921. When a cooling fan 931 of the heat-dissipating assembly 93 is operated, the external air is drawn into the receiving room 911 via the vents 912 and then exhausted out of the receiving room 911 via the through-holes 921 for dissipating the heat generated by the LED assembly 94.

However, the vents 912 are still located in a relatively upper portion of the lamp where the heat air exhausted from the through-holes 921 tends to gather. As a result, the heat air is re-drawn into the lamp via the vents 912, affecting the cooling efficiency of the lamp. Although the through-holes 921 are made in contact with the external air when the conventional lamp is inserted into the plate-type ceiling, the cooling efficiency of the lamp is not improved enough since the vents 912 are still located in the enclosed space right above the plate-type ceiling.

Therefore, it is desired to improve the conventional lamp.

SUMMARY OF THE INVENTION

It is therefore the primary objective of this invention to provide a lamp and a heat sink thereof so as to improve cooling efficiency of the lamp.

It is another objective of this invention to provide a lamp and a heat sink thereof so as to prolong service life of the lamp.

It is another objective of this invention to provide a lamp and a heat sink thereof so as to avoid turbulent flow.

The invention discloses a lamp comprising a housing, a heat sink, a fan and a light-emitting element. The housing includes an opening end and a compartment communicating with the opening end. The heat sink is disposed at the opening end and includes a lateral wall, a base, a plurality of first connection members, a plurality of first air channels and at least one second air channel, wherein each of the first connection members extends in a radial direction from the inner circumferential wall of the lateral wall towards a center of the base, and has a first end and a second end in a radial direction, with the first end connecting with the inner circumferential wall of the lateral wall and with the second end extending towards a center of the first face. The base is surrounded by and spaced from the lateral wall. The base is connected to an inner circumferential wall of the lateral wall via the first connection members, wherein each of the first air channels is formed between adjacent two of the first connection members and extended in the radial direction. The at least one second air channel is formed between an outer circumferential wall of the lateral wall and an inner face of the housing. The fan is disposed at one side of the heat sink in the compartment. The light-emitting element is disposed at another side of the heat sink.

Furthermore, the invention discloses a heat sink of a lamp comprising a lateral wall, a plurality of first connection members, a base, a plurality of first air channels and a second connection member. The base is surrounded by and spaced from the lateral wall, and connected to an inner circumferential wall of the lateral wall via the first connection members. Each of the first air channels is formed between adjacent two of the first connection members. The second connection member is connected to an outer circumferential wall of the lateral wall.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
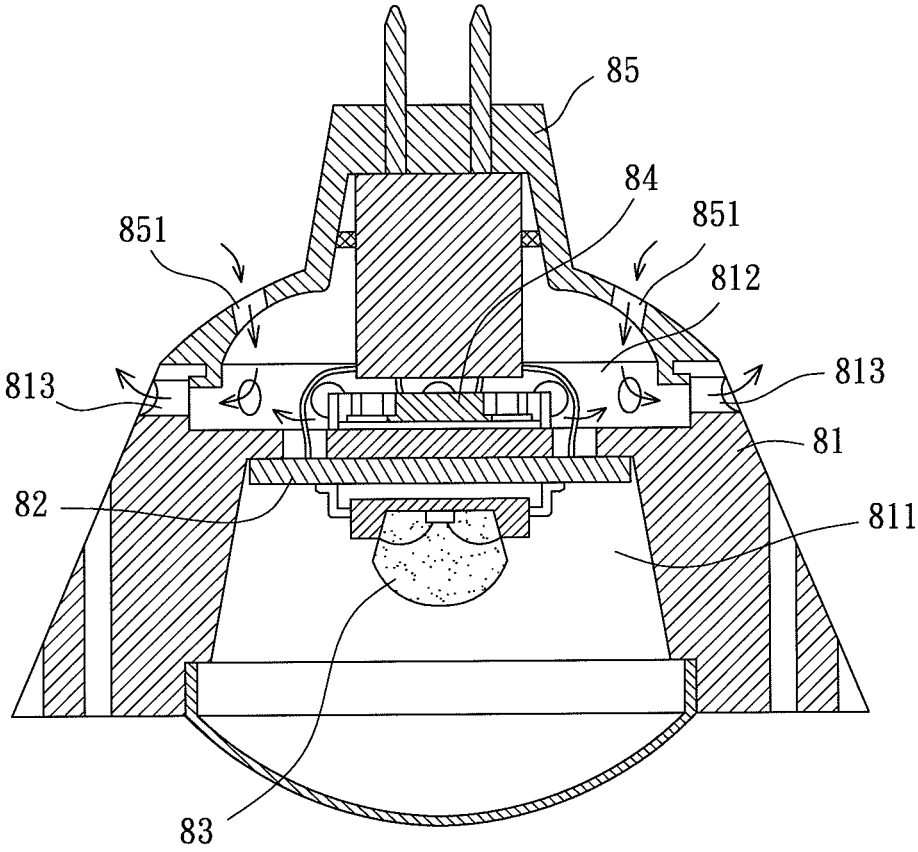
FIG. 1 PRIOR ART
FIG. 1 shows a side cross sectional view of a conventional lamp.
Figure 2:
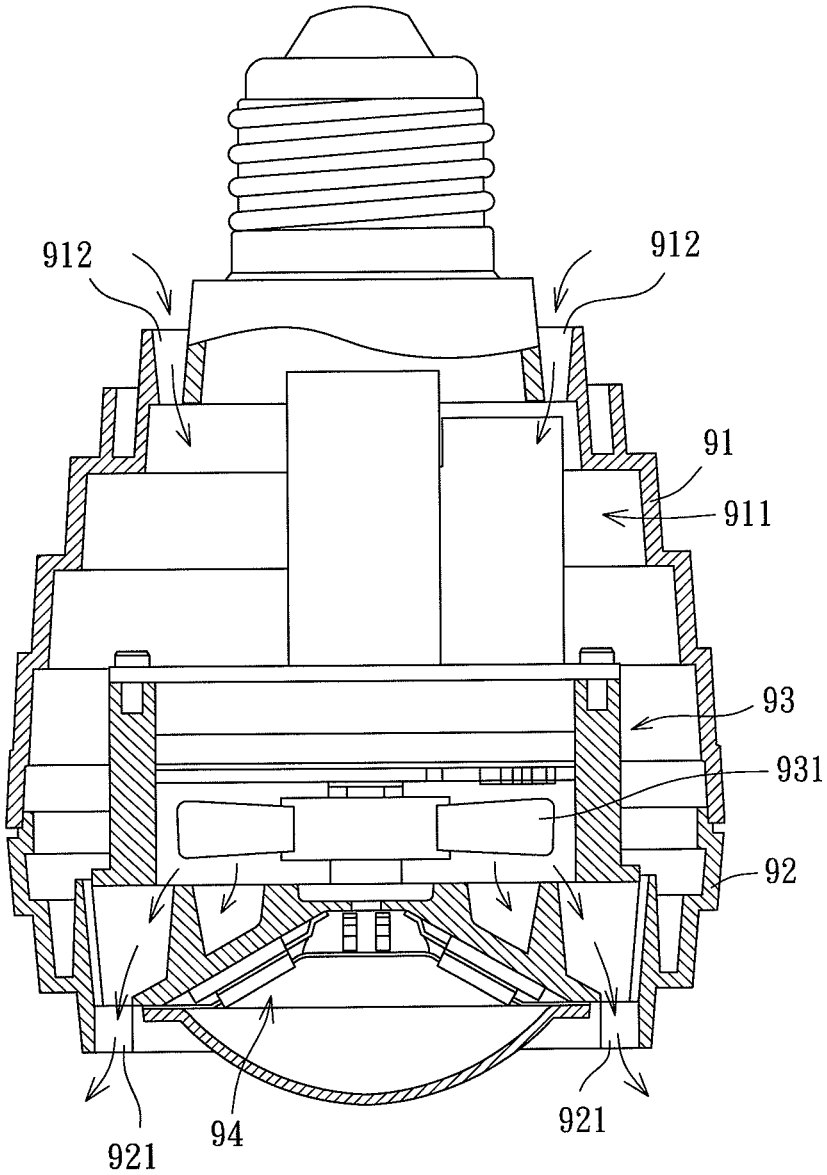
FIG. 2 PRIOR ART
FIG. 2 shows a side cross sectional view of another conventional lamp.

In the various figures of the drawings, the same numerals designate the same or similar parts. Furthermore, when the term "first", "second", "third", "fourth", "inner", "outer" "top", "bottom" and similar terms are used hereinafter, it should be understood that these terms are reference only to the structure shown in the drawings as it would appear to a person viewing the drawings and are utilized only to facilitate describing the invention.

DETAILED DESCRIPTION OF THE INVENTION

Figure 3:
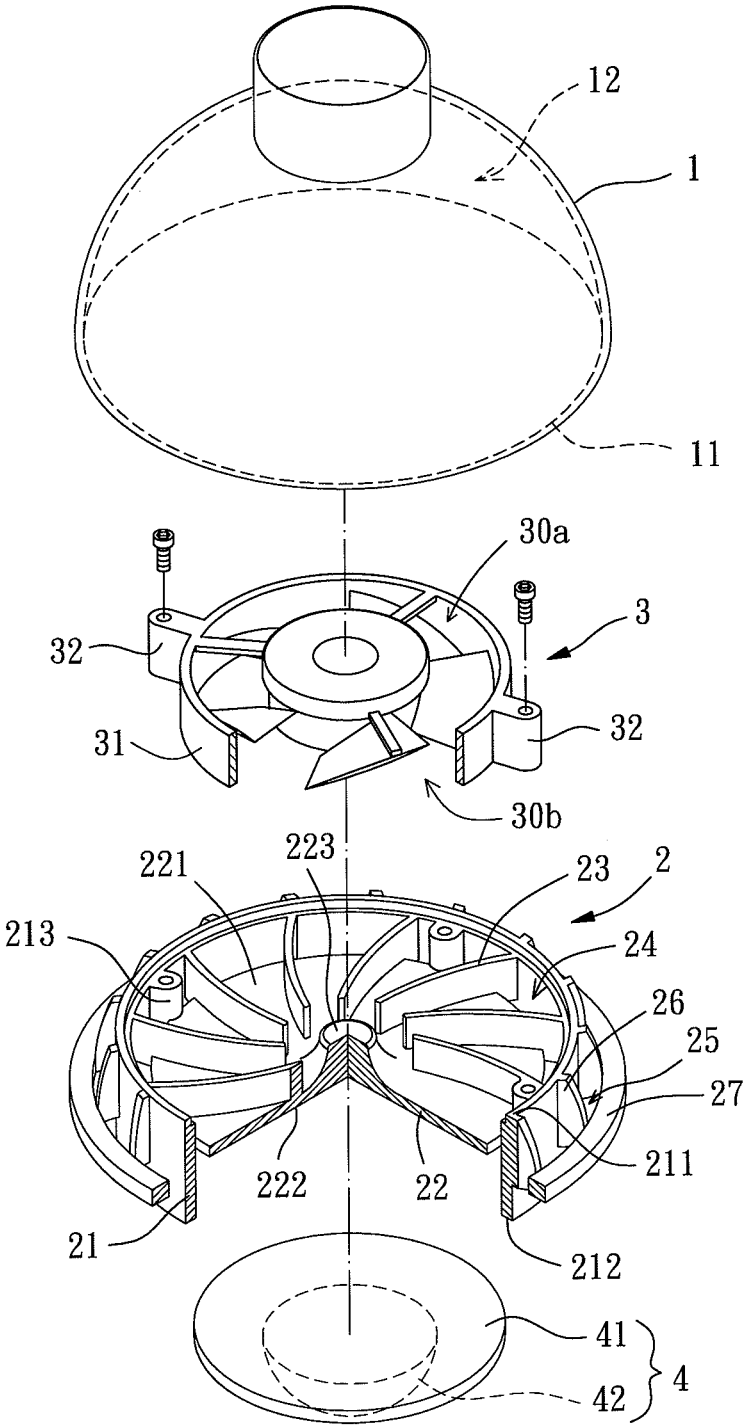
FIG. 3 shows an exploded diagram of a lamp according to a first embodiment of the invention.

Referring to FIG. 3, a lamp comprising a housing 1, a heat sink 2, a fan 3 and a light-emitting element 4 is disclosed according to a first embodiment of the invention. The heat sink 2 is disposed between the fan 3 and light-emitting element 4 and covered by the housing 1 when assembling the lamp. During operation of the fan 3, heat air inside the lamp may flow through the heat sink 2 to exchange with the external air for heat dissipation of the light-emitting element 4.

The housing 1 includes an opening end 11 on an end thereof, as well as a compartment 12.

Figure 4:
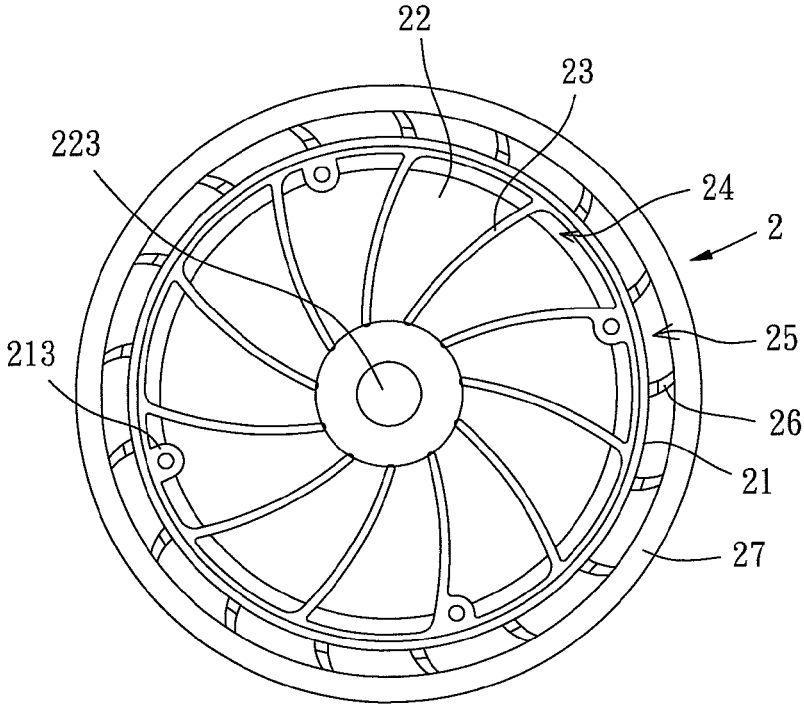
FIG. 4 shows a top view of a heat sink of the lamp according to the first embodiment of the invention.

Referring to FIGS. 3 and 4, the heat sink 2 is disposed at the opening end 11 of the housing 1 and preferably made of materials with high heat conductivity. The heat sink 2 includes a lateral wall 21, a base 22, a plurality of first connection members 23 extended in a radial direction, a plurality of first air channels 24 and at least one second air channel 25.

The lateral wall 21 may be an annual wall. The base 22 is surrounded by and spaced from the lateral wall 21. The base 22 is connected to an inner circumferential wall of the lateral wall 21 via the first connection members 23. Each first air channel 24 is formed between two adjacent first connection members 23, and includes a first end communicating with the compartment 12 and a second end locating around the opening end 11. The base 22 includes a first face 221 and a second face 222, with the first face 221 facing the compartment 12 and the second face 222 opposite to the first face 221. Each first connection member 23 may be a fin which extends in a radial direction from the inner circumferential wall of the lateral wall 21 towards a center of the lateral wall 21. Each of the first connection members 23 has a first end and a second end in the radial direction, with the first end connecting with the inner circumferential wall of the lateral wall and with the second end stretching into a position axially between the fan 3 and the base 22. Each first connection member 23 is designed to protrude out of the first face 221 to increase the heat exchange area of the first face 221. In addition, the first face 221 includes a protrusion 223 in a center thereof.

The at least one second air channel 25 is formed between an outer circumferential wall of the lateral wall 21 and an inner face of the housing 1. In the embodiment, the outer circumferential wall of the lateral wall 21 includes a second connection member 26 extending outwards therefrom. The second connection member 26 may be integrally formed with or connected to the lateral wall 21. The second connection member 26 may include a plurality of fins to increase heat exchange area of the outer circumferential wall of the lateral wall 21, and the number of the at least one second air channel 25 is plural, with adjacent two of the fins having one of the second air channels 25 formed therebetween. The at least one second air channel 25 includes a first end communicating with the compartment 12 and a second end located on the opening end 11. In addition, the second connection member 26 may be connected to and surrounded by an outer ring portion 27. The outer ring portion 27 may be an integrally-formed ring (as shown in FIG. 3) or a plurality of linking members circularly arranged in a ring-like route while any two of the linking members are spaced apart. Through the outer ring portion 27, the heat sink 2 may be assembled with the housing 1 in a way allowing the lateral wall 21 to protrude out of the opening end 11. The outer ring portion 27 may be disposed at the opening end 11 of the housing 1.

The lateral wall 21 includes an upper edge 211 and a lower edge 212 opposite to the upper edge 211. The upper edge 211 and the first face 221 of the base 22 both face the compartment 12. The lower edge 212 preferably protrudes out of the outer ring portion 27 along an axial direction away from the housing 1. The lower edge 212 may also protrude out of the second face 222 of the base 22 along the axial direction away from the housing 1 so as to separate the second ends of the first air channels 24 from the second end of the at least one second air channel 25.

The fan 3 is disposed at one side of the heat sink 2 in the compartment 12 and includes two sides **30*a* and 30*b*, with the first ends of the first air channels 24 communicating with the side 30*b* and the first end of the at least one second air channel 25 communicating with the side 30*a*. Based on this, the fan 3 may guide airs to flow between the first air channels 24 and the at least one second air channel 25. The fan 3 includes a frame 31 having a plurality of assembly portions 32. The lateral wall 21 may also include a plurality of fixing portions 213 for which the fan 3 is fixed on the heat sink 2 via a plurality of fixing members extending into the assembly portions 32 and the fixing portions 213**.

The light-emitting element 4 is disposed at another side of the heat sink 2 and includes a base plate 41 and at least one light-emitting member 42. The at least one light-emitting member 42 may preferably be a LED module disposed on one side of the base plate 41.

Figure 5:
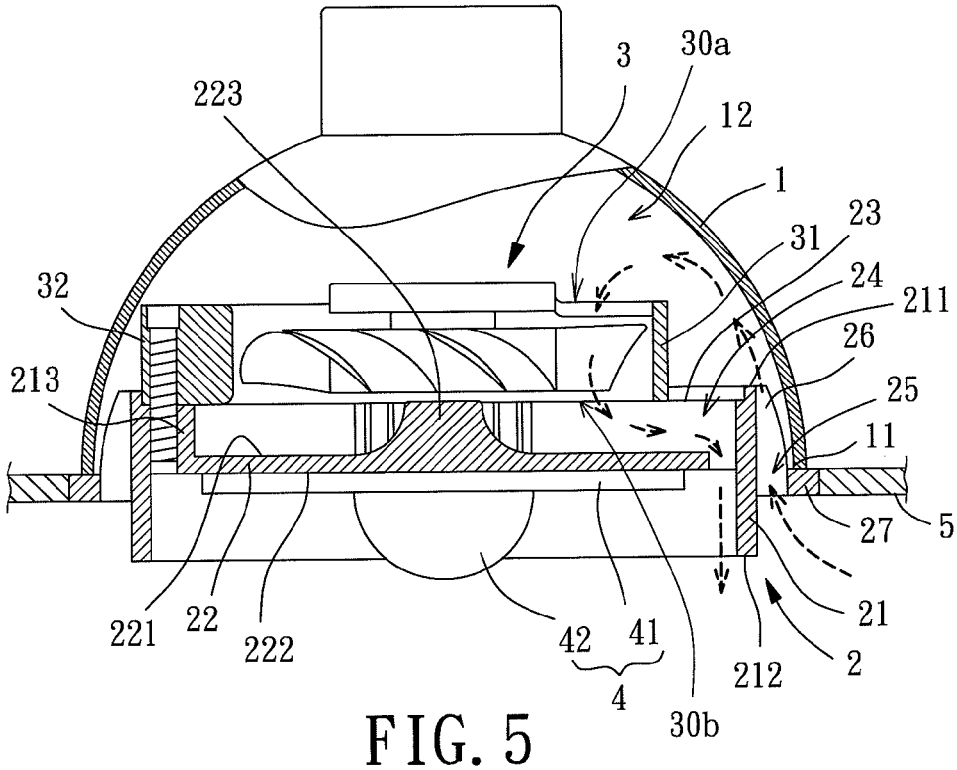
FIG. 5 shows a side cross sectional view of the lamp according to the first embodiment of the invention.

Referring to FIGS. 3 and 5, after the lamp is assembled, the fan 3 and the light-emitting element 4 are disposed on two sides of the heat sink 2, with the fan 3 facing the first face 221 of the base 22 and being supported by the protrusion 223. The light-emitting element 4 is coupled to the second face 222 of the base 22 via the base plate 41 thereof. The heat sink 2 is disposed at the opening end 11 of the housing 1 via the outer ring portion 27 in order for the fan 3 to be received in the compartment 12 and for the at least one light-emitting member 42 to be exposed outside at the opening end 11. Furthermore, because of the facts that the first ends of the first air channels 24 communicate with the side **30*b* and the first end of the at least one second air channel 25 communicates with the side 30*a*, as well as that the second ends of the first air channels 24 and the at least one second air channel 25 communicate with the external air, the external air may be drawn into the compartment 12 through one of the first air channels 24 and the at least one second air channel 25 and then exhausted out of the compartment 12 through another one. Note that there exists a difference in axial height between the second ends of the first air channels 24 and the second end of the at least one second air channel 25**. With the difference in axial height, the drawn-in external air may be separated from the exhausted heat air.

Referring to FIG. 5, when in use, the housing 1 is inserted into a plate-type ceiling 5, with the outer ring portion 27 preferably abutting with the plate-type ceiling 5. When the fan 3 is operated, the external air may be drawn into the compartment 12 through the first air channels 24 and the least one second air channel 25 and then dispelled out of the compartment 12 through another one. In addition, rotation direction of the fan 3 may be changed to control direction of air flow. For example, when the fan 3 rotates in a counterclockwise direction, the external air may be drawn into the compartment 12 via the at least one second air channel 25 and then dispelled out of the compartment 12 via the first air channels 24. To the contrary, when the fan 3 rotates in a clockwise direction, the external air may be drawn into the compartment 12 via the first air channels 24 and then dispelled out of the compartment 12 via the at least one second air channel 25. Thus, heat generated by the light-emitting element 4 is dispelled.

Despite the direction of the air flow, the first air channels 24 and the at least one second air channel 25 are arranged to contact with the external air beneath the plate-type ceiling 5, thus ensuring better ventilation of the lamp. In addition, due to the difference in axial height between the first air channels 24 and the at least one second air channel 25, as well as that the second ends of the first air channels 24 are separated from the second end of the at least one second air channel 25 by the lateral wall 21, the air drawn into the compartment 12 may be separated from the exhausted heat air to avoid turbulent flow. Thus, better ventilation and cooling efficiency are achieved.

Figure 6:
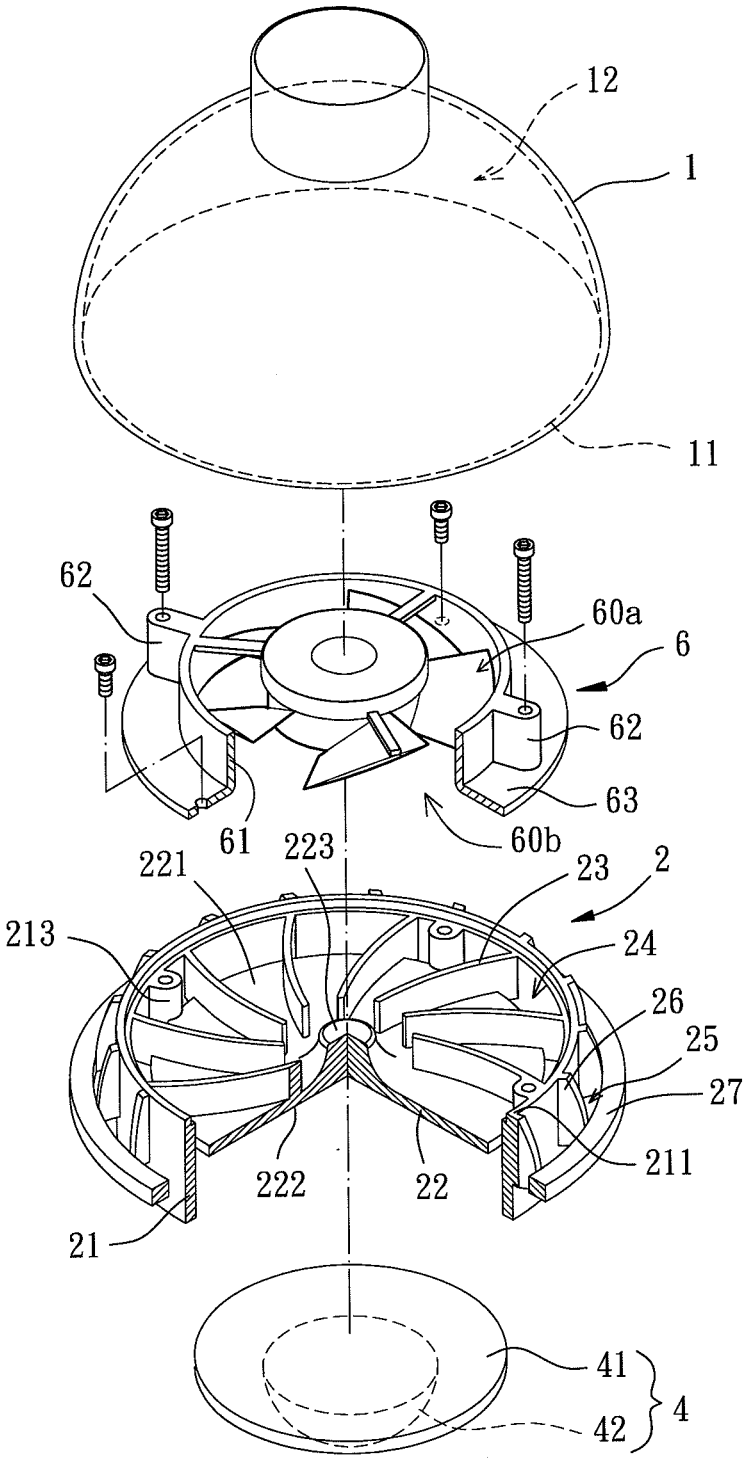
FIG. 6 shows an exploded diagram of a lamp according to a second embodiment of the invention.
Figure 7:
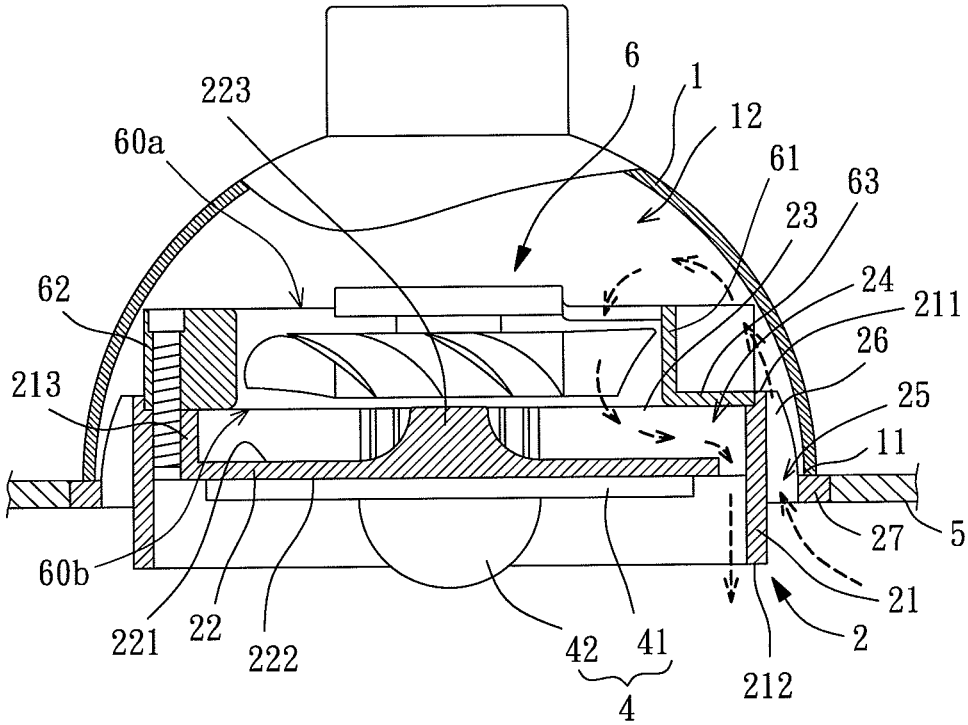
FIG. 7 shows a side cross sectional view of the lamp according to the second embodiment of the invention.

Referring to FIGS. 6 and 7, a lamp comprising a housing 1, a heat sink 2, a fan 6 and a light-emitting element 4 is disclosed according to a second embodiment of the invention. The fan 6 also includes two sides 60*a* and 60*b*, a frame 61 and a plurality of assembly portions 62.

In comparison with the frame 31 of the first embodiment, the frame 61 further includes a separation portion 63 which is an annual plate extending outwards from an outer circumferential wall of the frame 61. The separation portion 63 includes an outer periphery preferably covering the upper edge 211 of the lateral wall 21.

Based on this, when the fan 6 rotates in a counterclockwise direction, the external air may be drawn into the compartment 12 via the at least one second air channel 25 and then dispelled out of the compartment 12 via the first air channels 24. To the contrary, when the fan 6 rotates in a clockwise direction, the external air may be drawn into the compartment 12 via the first air channels 24 and then dispelled out of the compartment 12 via the at least one second air channel 25.

However, despite the direction of the air flow, the separation portion 63 may guide the airs in the first air channels 24 and the at least one second air channel 25 to pass the fan 6 merely through the sides 60*a* and 60*b*, preventing the turbulent flow from occurrence.

Figure 8:
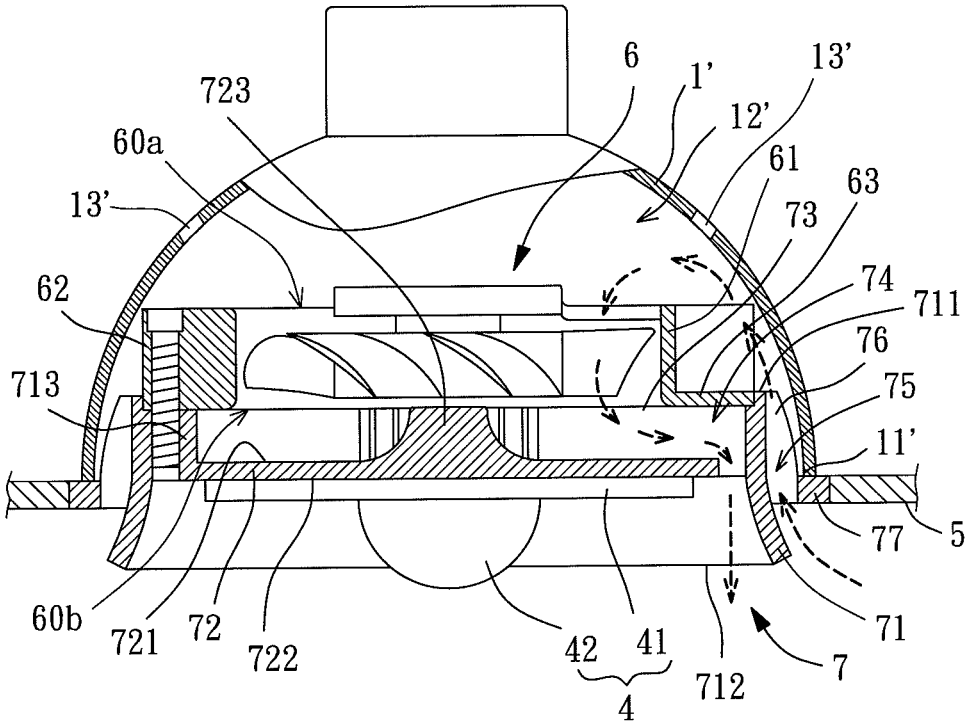
FIG. 8 shows a side cross sectional view of a lamp according to a third embodiment of the invention.

Referring to FIG. 8, a lamp comprising a housing 1', a heat sink 7, a fan 6 and a light-emitting element 4 is disclosed according to a third embodiment of the invention. The housing 1' also includes an opening end 11' and compartment 12'. The heat sink 7 also includes a lateral wall 71, an upper edge 711, a lower edge 712, a fixing portion 713, a base 72, a first face 721, a second face 722, a protrusion 723, a plurality of first connection members 73, a plurality of first air channels 74, at least one second air channel 75, a second connection member 76 and an outer ring portion 77.

In comparison with the first and second embodiments, the housing 1' further includes at least one through-hole 13'. In the embodiment, the housing 1' includes a plurality of through-holes 13'. Based on this, when the air passes through the at least one second air channel 75, the through-holes 13' may allow extra air to flow into or out of the at least one second air channel 75, providing better cooling efficiency and reducing the noise generated by turbulent flow. Furthermore, a portion of the lateral wall 71 adjacent to the lower edge 712 is designed to have gradually extended away from a center of the lateral wall 71, increasing the air throughput of the first air channels 74.

Based on the above description, by facilitating the ventilation of the lamp, the heat generated by the light-emitting element 4 may be rapidly dispelled. Thus, service life of the lamp is prolonged.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A lamp, comprising:

a housing including an opening end and a compartment communicating with the opening end;

a heat sink disposed at the opening end and including a lateral wall, a base, a plurality of first connection members, a plurality of first air channels and at least one second air channel, wherein the base includes a first face and a second face opposite to the first face, the first face faces the compartment, and each of the first connection members is a fin protruding out of the first face of the base and extending in a radial direction from the inner circumferential wall of the lateral wall towards a center of the first face, wherein each of the first connection members has a first end and a second end in the radial direction, with the first end connecting with the inner circumferential wall of the lateral wall and with the second end extending towards a center of the first face, wherein the base is surrounded by and spaced from the lateral wall, the base is connected to an inner circumferential wall of the lateral wall via the first connection members, each of the first air channels is formed between adjacent two of the first connection members, and extended in the radial direction, and the at least one second air channel is formed between an outer circumferential wall of the lateral wall and an inner face of the housing;

a fan disposed at one side of the heat sink in the compartment, with the fan having a lower side and a separation portion, with the lower side of the fan facing the heat sink and having an opening, with the separation portion extending from the opening to the lateral wall of the heat sink, and with the second end of each of the first connection members stretching into a position axially between the fan and the base; and a light-emitting element disposed at another side of the heat sink.

2. The lamp as claimed in claim 1, wherein the fan includes two sides, each of the first air channels includes a first end communicating with one of the sides and a second end facing the opening end, and the at least one second air channel includes a first end communicating with another one of the sides and a second end facing the opening end.

3. The lamp as claimed in claim 2, wherein a difference in axial height exists between the second ends of the first air channels and the second end of the at least one second air channel.

4. The lamp as claimed in claim 1, wherein the first air channels and the at least one second air channel communicate with the sides of the heat sink.

5. The lamp as claimed in claim 1, wherein the lateral wall includes a second connection member having a plurality of fins and extending outwards from the outer circumferential wall thereof.

6. The lamp as claimed in claim 5, wherein the second connection member is connected to and surrounded by an outer ring portion disposed at the opening end of the housing.

7. The lamp as claimed in claim 6, wherein the outer ring portion is an integrally-formed ring or a plurality of linking members circularly arranged in a ring-like route.

8. The lamp as claimed in claim 6, wherein the lateral wall includes an upper edge and a lower edge opposite to the upper edge, the upper edge faces the compartment and connects with the separation portion, and the lower edge protrudes out of the outer ring portion along an axial direction away from the housing.

9. The lamp as claimed in claim 8, wherein the base includes a first face and a second face opposite to the first face, the first face faces the compartment, and the lower edge protrudes out of the second face of the base along the axial direction away from the housing.

10. The lamp as claimed in claim 1, wherein the light-emitting element is coupled to the second face of the base via a base plate.

11. The lamp as claimed in claim 1, wherein the first face includes a protrusion.

12. The lamp as claimed in claim 8, wherein the separation portion includes an outer periphery covering the upper edge of the lateral wall.

13. The lamp as claimed in claim 8, wherein a portion of the lateral wall adjacent to the lower edge gradually extends away from a center of the lateral wall.

14. The lamp as claimed in claim 1, wherein the housing includes at least one through-hole.

* * * * *